US006238185B1

(12) United States Patent
Horng

(10) Patent No.: US 6,238,185 B1
(45) Date of Patent: May 29, 2001

(54) FAN WITH LOW NOISE, HIGH AIR FLOW AND HIGH WIND PRESSURE

(75) Inventor: Alex Horng, KaoHsung (TW)

(73) Assignee: Sunonwealth Electric Machine Industry Co., Ltd., Kaohsung (TW)

( * ) Notice: Subject to any disclaimer, the term of this patent is extended or adjusted under 35 U.S.C. 154(b) by 0 days.

(21) Appl. No.: 09/205,383

(22) Filed: Dec. 4, 1998

(51) Int. Cl.[7] ..... F04D 29/38

(52) U.S. Cl. ..... 416/223 R; 416/197 R; 416/197 A; 416/182; 416/183; 416/185

(58) Field of Search ..... 416/223 R, 238, 416/243, 244 R, 197 R, 197 A, 182, 183, 185

(56) References Cited

U.S. PATENT DOCUMENTS 4,722,608 * 2/1988 Salzman et al. ..... 366/330
5,226,783 * 7/1993 Mita ..... 416/223 R
5,320,493 * 6/1994 Shih et al. ..... 416/223 R
5,655,884 * 8/1997 Rose ..... 416/240

FOREIGN PATENT DOCUMENTS

259061 * 8/1987 (EP) ..... 416/223 R

* cited by examiner

*Primary Examiner*—F. Daniel Lopez
*Assistant Examiner*—James M. McAleenan
(74) *Attorney, Agent, or Firm*—Pennie & Edmonds LLP

(57) ABSTRACT

This invention relates to a fan. According to the rotational direction, the outermost point of the front side of the fan is leading to the innermost point of the front side such that the portion first contacting air is minimized and the noise of the fan is minimized. According to the rotational direction, the back of the fan blade recesses from the inner side and outer side of the fan blade to the center of the fan blade. According to the rotational direction, the frontage of the fan blade convexedly protrudes from the inner side and outer side of the fan blade to the center of the fan blade. The wake side is rounded. The diameter of the top side is smaller than that of the peripheral wall of the center portion. The invented fan improves noise, air flow and wind pressure.

7 Claims, 4 Drawing Sheets

FAN WITH LOW NOISE, HIGH AIR FLOW AND HIGH WIND PRESSURE

BACKGROUND OF THE INVENTION

1. Field of the Invention

This invention relates to a fan, particularly to a design of the shape of a fan and fan blades.

2. Description of the Prior Art

FIG. 1 shows the shape of a conventional fan. The conventional fan 1 comprises a center portion 11 and a plurality of fan blades 12. According to the rotational direction F, the outermost point 1211 of the front side 121 of fan blade 12 is equal in height to the innermost point 1212 of the front side 121. According to the rotational direction F, the front side 121 is a portion first contacting air. Because the whole face of the front side 121 first contacts air, the noise created by the conventional fan is very high. Furthermore, the wake side 122 is a plane surface such that the air contacting the fan blade can drain away from the wake side 122, and a turbulence is easily created to reduce the air flow and the wind pressure. It is necessary to provide a fan with low noise, high air flow and high wind pressure.

SUMMARY OF THE INVENTION

It is an object of the invention to provide fan blades for minimizing the portion of the blade which first contacts air, so that the noise of the fan blade is minimized.

It is another object of the invention to provide fan blades such that the air can smoothly contact the fan blades along the surface of the fan blade to improve air flow and wind pressure.

It is still another object of the invention to provide a fan blade such that air can smoothly drain away from the fan blade to improve air flow and wind pressure.

It is further another object of the invention to provide a fan such that the diameter of the top side is smaller than that of the peripheral wall for improving the air flow entering the fan.

Figure 1:
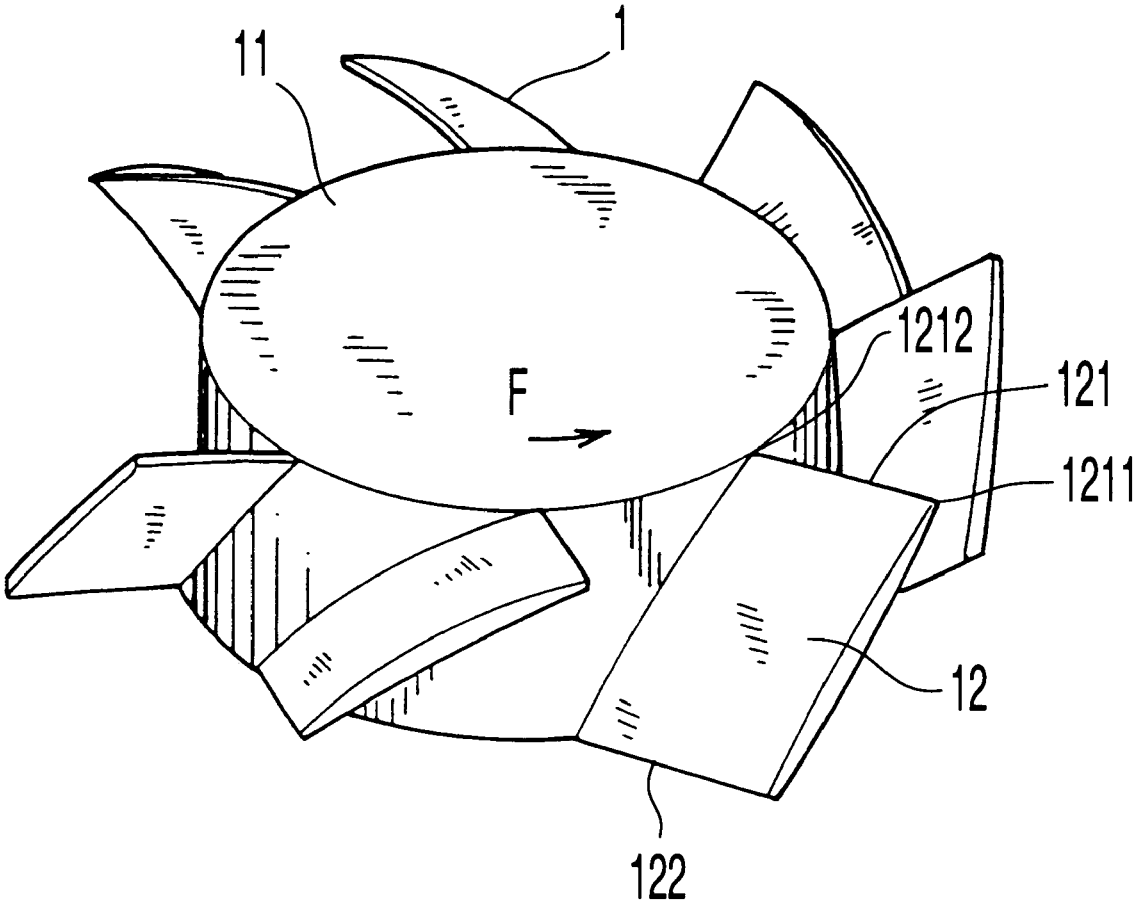
FIG. 1 (Prior Art)
FIG. 1 shows a conventional fan.

Table 1 shows a comparison of between the conventional fan and the invented fan, in respect of air flow, wind pressure and noise.

BRIEF DESCRIPTION OF THE ELEMENT MARK

1: fan
11: center portion
12: fan blade
121: front side
1211: outermost point
1212: innermost point
122: wake side
2: fan
21: center portion
211: center Point
212: top side
213: peripheral wall
214: oblique side
22: fan blade
221: inner side
222: outer side
223: back
224: frontage
225: front side
2251: outermost point
2252: innermost point
226: wake side
F: rotational direction

DETAILED DESCRIPTION OF THE INVENTION

Figure 2:
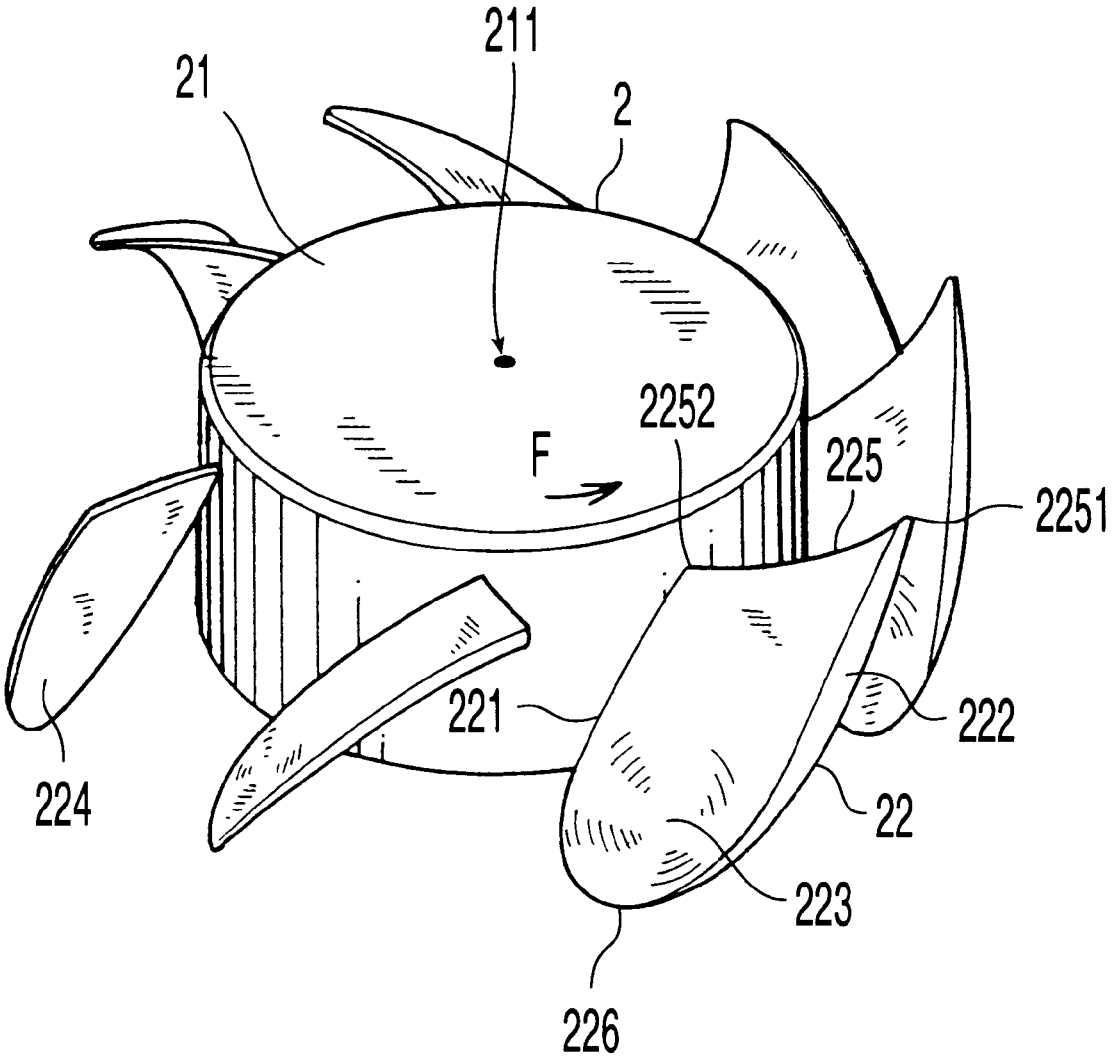
FIG. 2 shows a fan according to a preferred embodiment of the invention.
Figure 3:
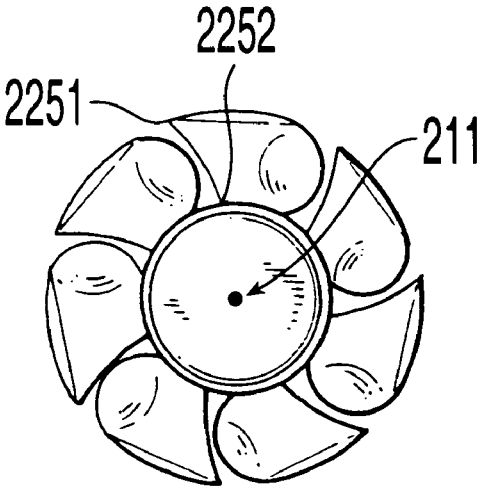
FIG. 3 is the top plan view of the fan according to the preferred embodiment of the invention.
Figure 4:
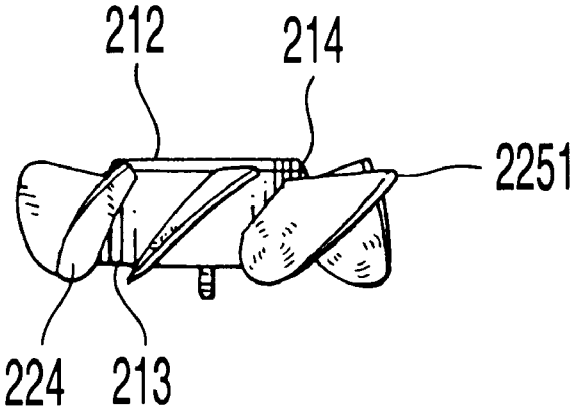
FIG. 4 is the side elevational view of the fan according to the preferred embodiment of the invention.

This invention provides a fan 2 with low noise, high air flow and high wind pressure. FIG. 2 shows a fan according to one preferred embodiment of the invention. The fan 2 comprises a center portion 21 and a plurality of fan blades 22. The fan blade 22 extends outwardly from the center portion 21 of the fan 2. Each fan blade 22 has an inner side 221 connecting to a peripheral wall of the center portion 21 of the fan 2. An outer side 222 is a peripheral side of the fan blade 22. The fan blade 22 comprises a back 223 and a frontage 224. A front side 225 is located at the front of fan blade 22 according to the rotational direction F, and a wake side 226 is located at the tail of fan blade 22 according to the rotational direction F. According to the rotational direction, the outermost point 2251 of the front side 225 is leading to the innermost point 2252 of the front side 225, and according to the rotational direction the outermost point 2251 of the front side 225 first contacts air such that the portion first contacting air is minimized from a surface to a point. Compared with the conventional fan, the portion first contacting air of the invention is almost minimal. When the fan rotates, the point first breaks through the air so as to lower noise created by the fan blade breaking the air. Table 1 shows a comparison between a conventional fan and the invented fan in respect of the air flow, wind pressure and noise. The motor and size of the two fans are the same. The difference is the shape and configuration of the fans. On the same speed (4500 rpm) and current consumption (0.19 A), the noise of the invented fan is 33 dB which is lower than the 35 dB noise of the conventional fan. FIG. 3 is the top plan view of the fan according to the embodiment of the invention. The three points, the outermost point 2251 and the innermost point 2252 of the front side 225 and the center point 211 of the center portion 21, form a circular configuration such that the resistance of the fan blade against the air is lowered. FIG. 4 is a side elevational view of the fan according to the preferred embodiment of the invention. The outermost point 2251 of the front side 225 is lower than the top side 212 of the center portion 21.

Figure 5:
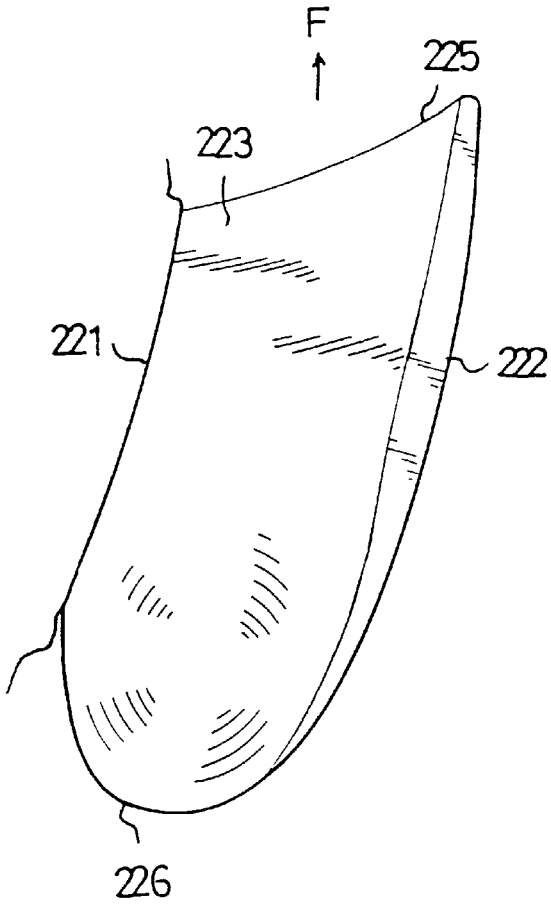
FIG. 5 shows the fan blade according to the preferred embodiment of the invention.
Figure 6:
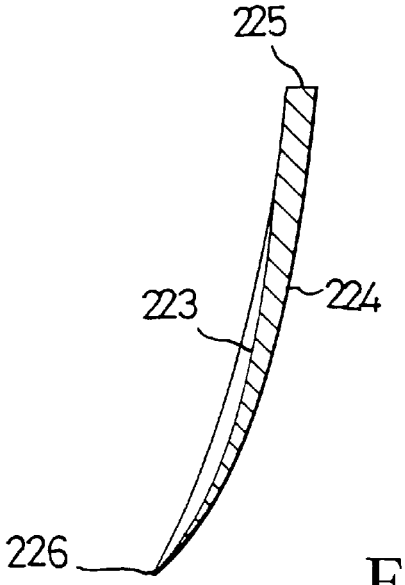
FIG. 6 is a cross-sectional view of FIG. 5.

FIG. 5 shows the fan blade according to the preferred embodiment of the invention. FIG. 6 is a cross-sectional view of the fan blade of FIG. 5. Referring to FIG. 5 and FIG. 6, according to the rotational direction F the back 223 of the fan blade 22 recesses from the inner side 221 and outer side 222 of the fan blade 22 to the center of the fan blade 22.

Besides, according to the rotational direction F the back 223 r excesses from the front side 225 to the wake side 226. Furthermore, the wake side 226 of the back 223 sticks up slightly. Due to the design of the back 223, air can smoothly contact the fan blades along the profile of the back 223 to make air flow stably and cause no turbulence so as to improve air flow and wind pressure.

Referring to FIG. 6, according to the rotational direction, the frontage 224 of the fan blade 22 convexedly protrudes from the inner side 221 and outer side 222 of the fan blade 22 to the center of the fan blade 22. Besides, according to the rotational direction, the frontage 224 of the fan blade 22 protrudes from the front side 225 to the wake side 226. In addition, the wake side 226 of the frontage 224 of the fan blade 22 sticks up slightly. Due to the design of the frontage 224, air can smoothly contact the fan blades along, the profile of the frontage 224 to make air flow stably and cause less turbulence so as to improve air flow and wind pressure.

The convention al fan blades drain air away from the wake side along an unsmooth path, such that a turbulence is easily created on the tall of the fan blades and air flow and wind pressure of the fan are affected. In order to drain the air smoothly away from the fan blades, the wake side 226 of the fan blade 22 is rounded (shown in FIG. 5) or is circular and slightly sharp. The air can drain away from fan blade 22 alone the rounded wake side 226 to avoid draining the air from the whole surface, such that the noise is low and the air on the tail of the fan blade is stabilized to improve air flow and wind pressure.

Referring to FIG. 4, an oblique side 214 forms between the peripheral wall 213 of the center portion 21 and the top side 212 of the center portion 21, such that the diameter of the top side 212 is smaller than that of the peripheral wall 213 for improving air flow entering the fan. Referring to Table 1, because of the invented fan's design, the air flow is 21 (CFM) and the wind pressure is 0.16 (inch/$H_2O$). They are higher than the air flow, 15.2 (CFM), and the wind pressure, 0.15 (inch/$H_2O$) of the conventional fan which proves the increased air flow and wind pressure of the invention. At the same speed, the air flow and wind pressure of the invention are higher than that of the conventional fan, besides the noise is lower than that of the conventional fan. The above facts prove the effectiveness of the invention.

TABLE 1

| | The conventional fan | The invented fan |
|---|---|---|
| Speed (rpm) | 4500 | 4500 |
| Current consumption (A) | 0.19 | 0.19 |
| Air flow (CFM) | 15.2 | 21 |
| Wind pressure (inch/$H_2O$) | 0.15 | 0.16 |
| Noise (dB) | 35 | 33 |

What is claimed is:

1. A fan blade extending outwardly from a center hub of an impeller, the fan blade comprising:

an inner side connected to a hub wall of the center hub of the impeller;

an outer side being a contour edge of the fan blade;

a front side located at a front of the fan blade according to a rotational direction; and a wake side located at a tail of the fan blade according to the rotational direction;

wherein according to the rotational direction, an outermost point of the front side is leading to an innermost point of the front side, according to the rotational direction, the outermost point of the front side first contacts the air such that the portion first contacting air is minimal and the outermost point of the front side of the fan blade, the innermost point of the front side of the fan blade and the center point of the center portion of the fan all lay on a substantially circular arc which includes the front edge of the fan blade, in a top plan view of the fan.

2. A fan blade extending outwardly from a center hub of an impeller and according to a rotational direction the fan blade having a frontage and a back, the fan blade comprising:

an inner side connected to a hub wall of the center hub of the impeller;

an outer side being a contour edge of the fan blade;

a front side located at a front of the fan blade according to the rotational direction; and a wake side located at a tail of the fan blade according to the rotational direction;

wherein according to the rotational direction, the back of the fan blade is concave from the inner side and the outer side of the fan blade to the center of the fan blade, and the back of the fan blade is concave from the front side to the wake side.

3. The fan blade as claimed in claim 2, wherein the wake side of the back of the fan blade sticks up slightly and terminates in a curved contour so as to promote stable air flow and reduce turbulence.

4. A fan blade extending outwardly from a center hub of an inpeller and according to a rotational direction the fan blade having a frontage and a back, the fan blade comprising:

an inner side connected to a hub wall of the center hub of the impeller;

an outer side being a contour edge of the fan blade;

a front side located at a front of the fan blade according to the rotational direction; and a wake side located at a tail of the fan blade according to the rotational direction;

wherein according to the rotational direction, the frontage of the fan blade is convex from the inner side and the outer side of the fan blade to the center of the fan blade, and according to the rotational direction, the frontage of the fan blade is convex from the front side to the wake side.

5. The fan blade as claimed in claim 4, wherein the wake side of the frontage of the fan blade sticks up slightly and terminates in a curved contour so as to promote stable air flow and reduce turbulence.

6. A fan blade extending outwardly from a center hub of an impeller and according to a rotational direction the fan blade having a frontage and a back, the fan blade comprising:

an inner side connected to a hub wall of the center hub of the impeller;

an outer side being a contour edge of the fan blade;

a front side located at a front of the fan blade according to the rotational direction; and a wake side located at a tail of the fan blade according to the rotational direction;

wherein the wake side is outwardly rounded and provided with a circular contour such that air can drain smoothly away from the fan blade.

7. A fan blade extending outwardly from a center hub of an impeller, the fan blade having a frontage and a back defined in accordance with a rotational direction thereof, the fan blade comprising:

an inner side connected to a hub wall of the center hub of the impeller;

an outer side forming a contour edge of the fan blade;

a front side located at a leading portion of the fan blade in accordance with the rotational direction; and a wake side located at a trailing portion of the fan blade in accordance with the rotational direction;

wherein the frontage of the fan blade is convexly bowed in the rotational direction, from the inner and outer sides to the center of the fan blade, and also from the front side to the wake side, the back of the fan blade is concavely bowed, from the inner and outer sides to the center of the fan blade, and also from the front side to the wake side, and the wake side is outwardly rounded.

* * * * *